United States Patent [19]

Kim

[11] Patent Number: 4,671,000

[45] Date of Patent: Jun. 9, 1987

[54] BUCKET TEETH

[76] Inventor: Young T. Kim, 8556 Rich Ave. S., Bloomington, Minn. 55437

[21] Appl. No.: 788,833

[22] Filed: Nov. 18, 1985

[51] Int. Cl.[4] ..... E02F 9/28

[52] U.S. Cl. ..... 37/142 R; 172/777; 172/713

[58] Field of Search ..... 172/777, 778, 713; 37/142 R, 142 T, 141 T

[56] References Cited

U.S. PATENT DOCUMENTS

| | | | |
|---|---|---|---|
| 1,220,186 | 3/1917 | Chambers | 37/142 R |
| 2,164,988 | 7/1939 | De Biasi | 37/141 T |
| 2,705,380 | 4/1955 | Hensley | 37/142 R |
| 2,856,707 | 10/1958 | Coder | 37/142 R |
| 2,864,184 | 12/1958 | Fohr | 37/142 R |
| 3,281,972 | 11/1966 | Kerestes | 172/701.3 |
| 4,120,105 | 10/1978 | Stepe | 37/142 R |

*Primary Examiner*—Richard J. Johnson
*Attorney, Agent, or Firm*—Thomas B. Tate

[57] ABSTRACT

The invention is a new design for dipper teeth for bulldozer buckets, comprising a pair of teeth joined by a plate, each tooth having a flat, pointed front edge, longitudinal U-shaped slot at its rear end, and bolt means disposed through an opening in the top surface to hold the teeth in position on the bucket.

1 Claim, 3 Drawing Figures

BUCKET TEETH

SUMMARY AND BACKGROUND OF THE INVENTION

Excavation equipment such as front-end loaders or similar diggers are equipped with a bucket which has teeth which are used to dig and scrape dirt and rocks. The invention is an improved type of bucket teeth which are removeably mounted in pairs.

An object of the invention is to provide a type of bucket teeth which is mechanically stronger and less likely to break than conventional bucket teeth. This greater strength is achieved by mounting the teeth in pairs.

Another object of the invention is to provide teeth which are removeably mounted on the bucket, thereby allowing for easier installation and replacement, and also allowing the same bucket to be used with or without teeth.

DESCRIPTION OF THE INVENTION

Figure 1:
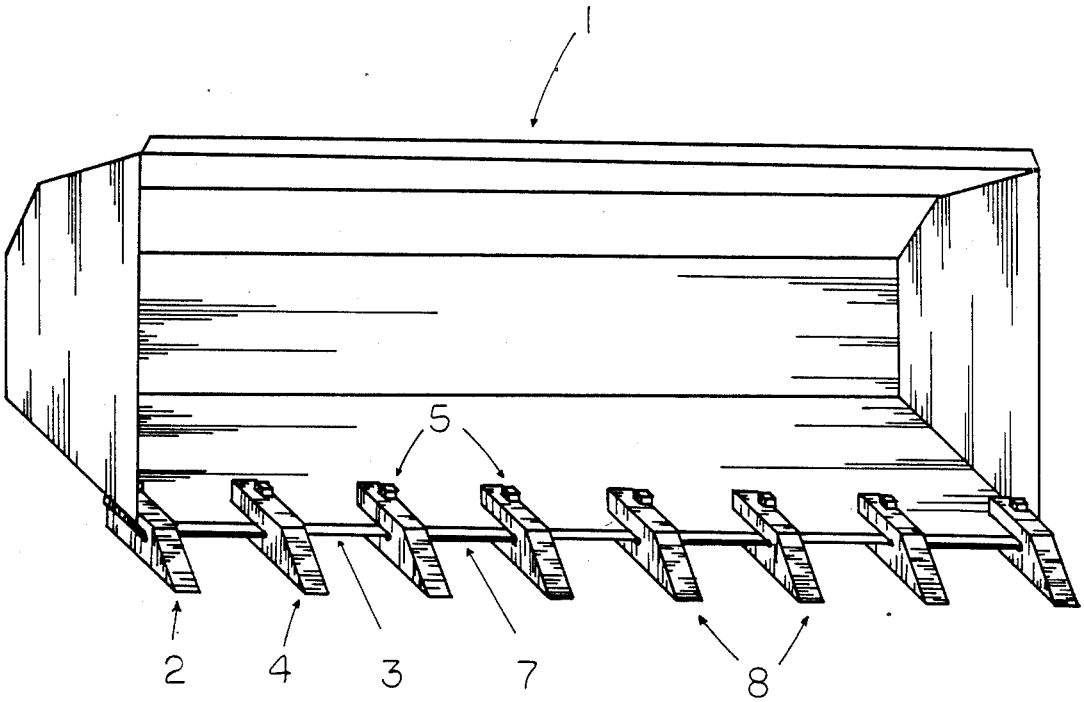
FIG. 1 is a front view of a bucket with the bucket teeth attached.
Figure 2:
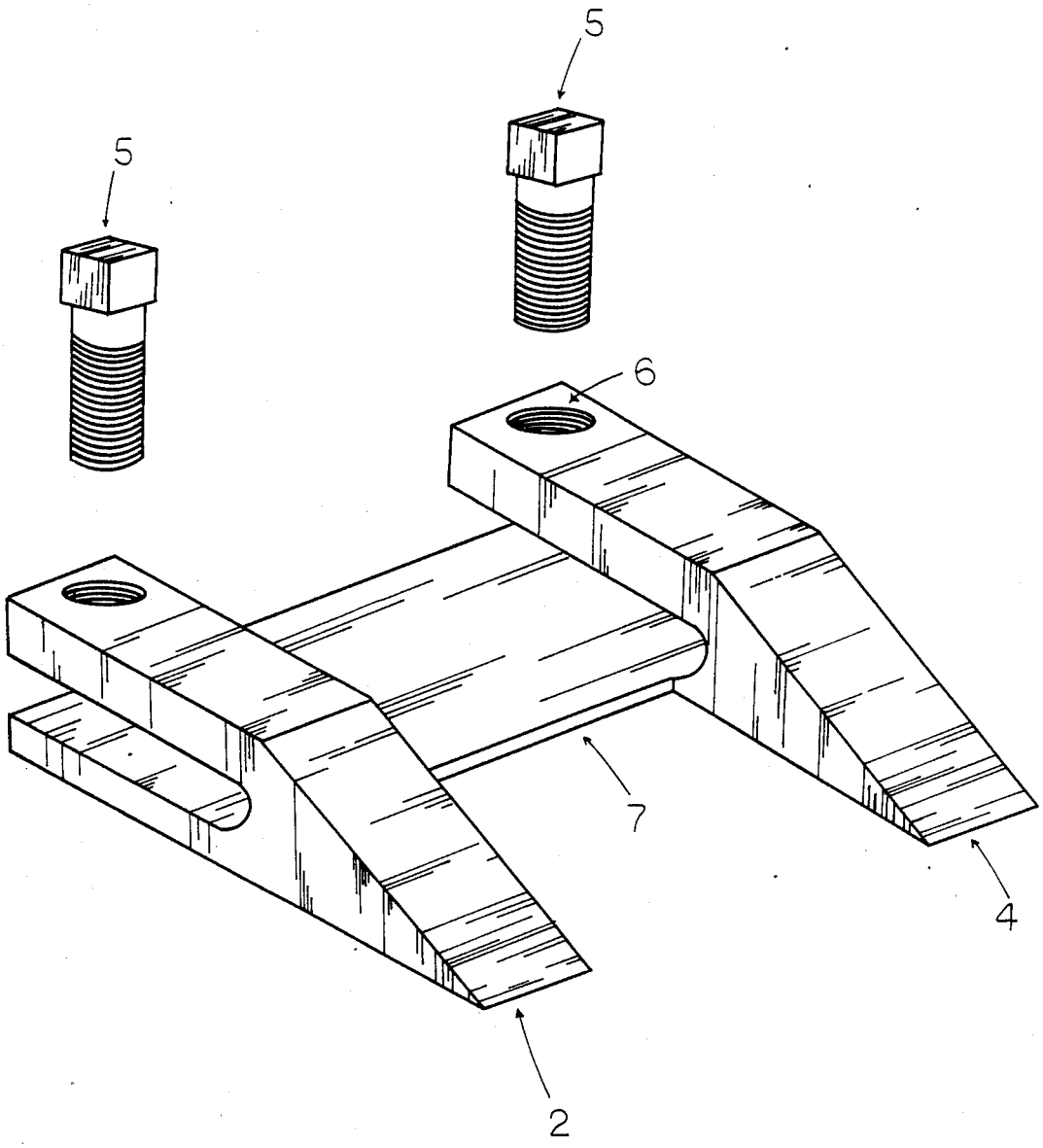
FIG. 2 is a front perspective view of one of the pairs of bucket teeth.
Figure 3:
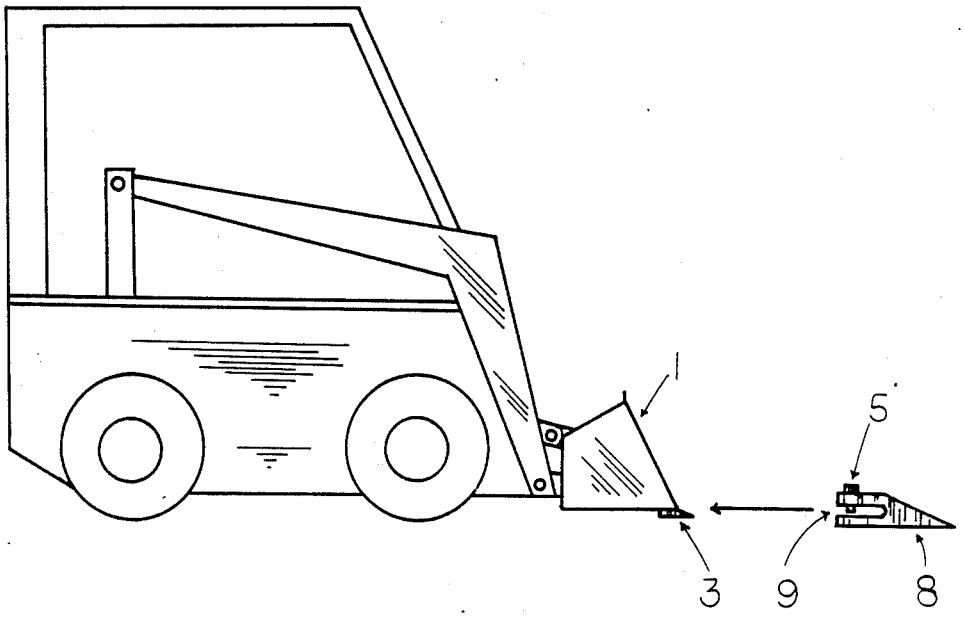
FIG. 3 is a side view showing the method of attachment of the teeth to the bucket.

The invention is an improved type of bucket teeth for attachment to the bucket 1 of a front-end loader or similar digger, said bucket 1 being provided with a bucket scraping edge or bucket braid 3.

The teeth 8 are constructed in pairs. Each pair of teeth 8 comprises a left tooth 2 and a right tooth 4 joined together by a flat plate member 7 which is welded to teeth 2 and 4. A longitudinal U-shaped slot 9 is defined between the top and bottom surfaces of each tooth 8, extending forward from the back end of the tooth. The plate 7 fits into the slots 9 and attaches under the bottom of the bucket 1.

In each tooth 8, a bolt or set screw 5 is disposed through a threaded hole 6 in the top of the tooth, penetrating into the U-shaped slot 9 to clamp the teeth 8 into place on the edge of the bucket 1. In the preferred embodiment of the invention, the bolt 5 in each tooth 8 contacts the top of the plate 7, and has a cupped bottom to grip tightly. The bolts 5 are easily removeable with a wrench so as to allow the teeth 8 to be removeably mounted on the bucket 1.

Optionally, if permanent mounting of the teeth is desired, an opening could be drilled in bucket 1 to allow the bolt 5 to penetrate the portion of tooth 8 which defines the top of slot 9 and also penetrate the bucket 1, and to contact the portion of tooth 8 which defines the bottom of slot 9.

Each tooth 8 has a flat, pointed edge which could be formed by two angle cuts on its upper forward area, or by a single angle cut, or could be straight. When my bucket teeth are used, dirt slides easily over the top of the teeth 8 to dig the ground in a straight line, or to scoop dirt and rocks. Optional features include round bolts, instead of hexagonal bolts, for use in digging gravel, and truncated teeth for use in digging trenches.

I claim:

1. A dipper tooth structure removeably mounted on the bucket of a front-end loader or the like, said structure comprising, in combination:

a plurality of teeth suitable for digging, scraping, and scooping earth, said teeth being aligned in side-by-side pairs, each pair consisting of two narrow teeth joined by a flat plate member, each of said teeth having a horizontal top portion and a horizontal bottom portion which define an elongated horizontal U-shaped slot extending forward from the back of said tooth, each of said teeth having a flat, pointed edge at its front end, and a bolt having a cupped bottom, said bolt being disposed vertically through an opening formed in the top of each said tooth into said U-shaped slot to hold said tooth in place on said bucket.

* * * * *